US008764166B2

(12) United States Patent
Miyajima et al.

(10) Patent No.: US 8,764,166 B2
(45) Date of Patent: Jul. 1, 2014

(54) LIQUID EJECTING HEAD AND LIQUID EJECTING APPARATUS

(75) Inventors: Hiroki Miyajima, Shiojiri (JP); Kimiyasu Otsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 345 days.

(21) Appl. No.: 13/075,135

(22) Filed: Mar. 29, 2011

(65) Prior Publication Data

US 2011/0242166 A1 Oct. 6, 2011

(30) Foreign Application Priority Data

Mar. 30, 2010 (JP) ..... 2010-079885

(51) Int. Cl.

| | |
|---|---|
| ***B41J 2/14*** | (2006.01) |
| ***B41J 2/16*** | (2006.01) |
| *B41J 2/04* | (2006.01) |
| *B41J 2/05* | (2006.01) |
| *B41J 2/45* | (2006.01) |

(52) U.S. Cl.

CPC .... *B41J 2/14072* (2013.01); *B41J 2002/14491* (2013.01)

USPC ..... 347/50; 347/20; 347/54; 347/56; 347/57; 347/58; 347/68

(58) Field of Classification Search

USPC ..... 347/20, 40, 50, 58, 66, 54, 56, 57, 68

See application file for complete search history.

(56) References Cited

U.S. PATENT DOCUMENTS 6,286,942 B1 * 9/2001 Miyazawa et al. ..... 347/68
7,729,091 B1 * 6/2010 Huang et al. ..... 360/264.2

FOREIGN PATENT DOCUMENTS

JP 2009-214368 A 9/2009

* cited by examiner

*Primary Examiner* — Laura Martin
*Assistant Examiner* — Jeremy Bishop
(74) *Attorney, Agent, or Firm* — Kilpatrick Townsend & Stockton LLP

(57) ABSTRACT

A liquid ejecting head includes a main liquid ejecting head body, in which is formed a liquid flow channel through which a liquid flows, that ejects the liquid from a nozzle opening using a pressurizing unit; a driving board configured so as to supply power to the pressurizing unit; a connector provided at an end portion of the driving board; and a holding member configured so as to hold the driving board in a bent state and erected relative to one end surface of the main liquid ejecting head body. The holding member has a stopping portion that holds an end of the driving board in which the connector is provided, and the configuration is such that the stopping portion prevents the driving board from opening in the direction of the bend.

3 Claims, 6 Drawing Sheets

LIQUID EJECTING HEAD AND LIQUID EJECTING APPARATUS

CROSS REFERENCES TO RELATED APPLICATIONS

The entire disclosure of Japanese Patent Application No. 2010-79885, filed Mar. 30, 2010, is expressly incorporated herein by reference.

BACKGROUND

1. Technical Field

The present invention relates to liquid ejecting heads and liquid ejecting apparatuses.

2. Related Art

An ink ejecting head in which a self-sealing unit, provided partway along a flow channel for supplying ink from a liquid supply source such as an ink cartridge to the ink ejecting head, is combined with the ink ejecting head can be given as a typical example of a liquid ejecting head. With the self-sealing unit in this ink ejecting head unit, ink is supplied from the ink cartridge to a reservoir in the ink ejecting head by a valve opening due to negative pressure within the reservoir caused by an ink droplet being ejected from a nozzle opening.

Such a liquid ejecting head in which a cavity that is open at the top and bottom is provided in the self-sealing unit and a driving board for inputting driving signals to piezoelectric elements is provided within the cavity in order to drive the piezoelectric elements is known, as disclosed in JP-A-2009-214368. The driving board is configured of a film that can be bent. In this type of liquid ejecting head, a connector for a driving wire exposed from the upper opening of the cavity is connected to a connector of a printer cable, whereas a terminal portion of the driving wire exposed from the lower opening of the cavity is connected to a wiring member provided on the piezoelectric element. The configuration is such that driving signals from a printer can be inputted into the piezoelectric element via the printer cable, the driving wire, and the wiring member.

With the liquid ejecting head disclosed in JP-A-2009-214368, the driving board is disposed in the upper area of a head case in which the piezoelectric element is housed, is bent along a bending line, and is held so as not to open up in the bending direction by fitting a projection portion of a holding member provided in a position above the driving board into a hole portion of the driving board. While holding the driving board in this state, the driving board and holding member are inserted into the cavity of the self-sealing unit, and the self-sealing unit is disposed on the top of the head case.

However, the connector is provided in the upper portion of the driving board, and because the connector is heavy, it cannot be anchored and held by the holding member, resulting in situations where the driving board opens up in the opposite direction of the bend. Accordingly, there is a problem in that when the self-sealing unit is installed on the top of the head case during the assembly process, the driving board opens up and becomes difficult to insert into the cavity of the self-sealing unit, thus making it difficult to install the self-sealing unit. There is a further problem in that even after assembly, the connector portion wobbles and makes it difficult to insert and anchor the printer cable. This in turn increases the defect rate during the manufacture of the liquid ejecting head.

SUMMARY

An advantage of some aspects of the invention is to provide a liquid ejecting head capable of holding a driving board in a bent state and a liquid ejecting apparatus that employs such a liquid ejecting head.

A liquid ejecting head according to an aspect of the invention includes at least the following: a main liquid ejecting head body, in which is formed a liquid flow channel through which a liquid flows, that ejects the liquid from a nozzle opening using a pressurizing unit; a driving board configured so as to supply power to the pressurizing unit; a connector provided at an end portion of the driving board; and a holding member configured so as to hold the driving board in a bent state and erected relative to one end surface of the main liquid ejecting head body. The holding member has a stopping portion that holds an end of the driving board in which the connector is provided, and the configuration is such that the stopping portion prevents the driving board from opening in the direction of the bend.

A liquid ejecting apparatus according to another aspect of the invention includes the stated liquid ejecting head.

BRIEF DESCRIPTION OF THE DRAWINGS

The invention will be described with reference to the accompanying drawings, wherein like numbers reference like elements.

FIG. 5A is a partial exploded cross-sectional view of a head according to an embodiment of the invention, whereas

DESCRIPTION OF EXEMPLARY EMBODIMENTS

Figure 1:
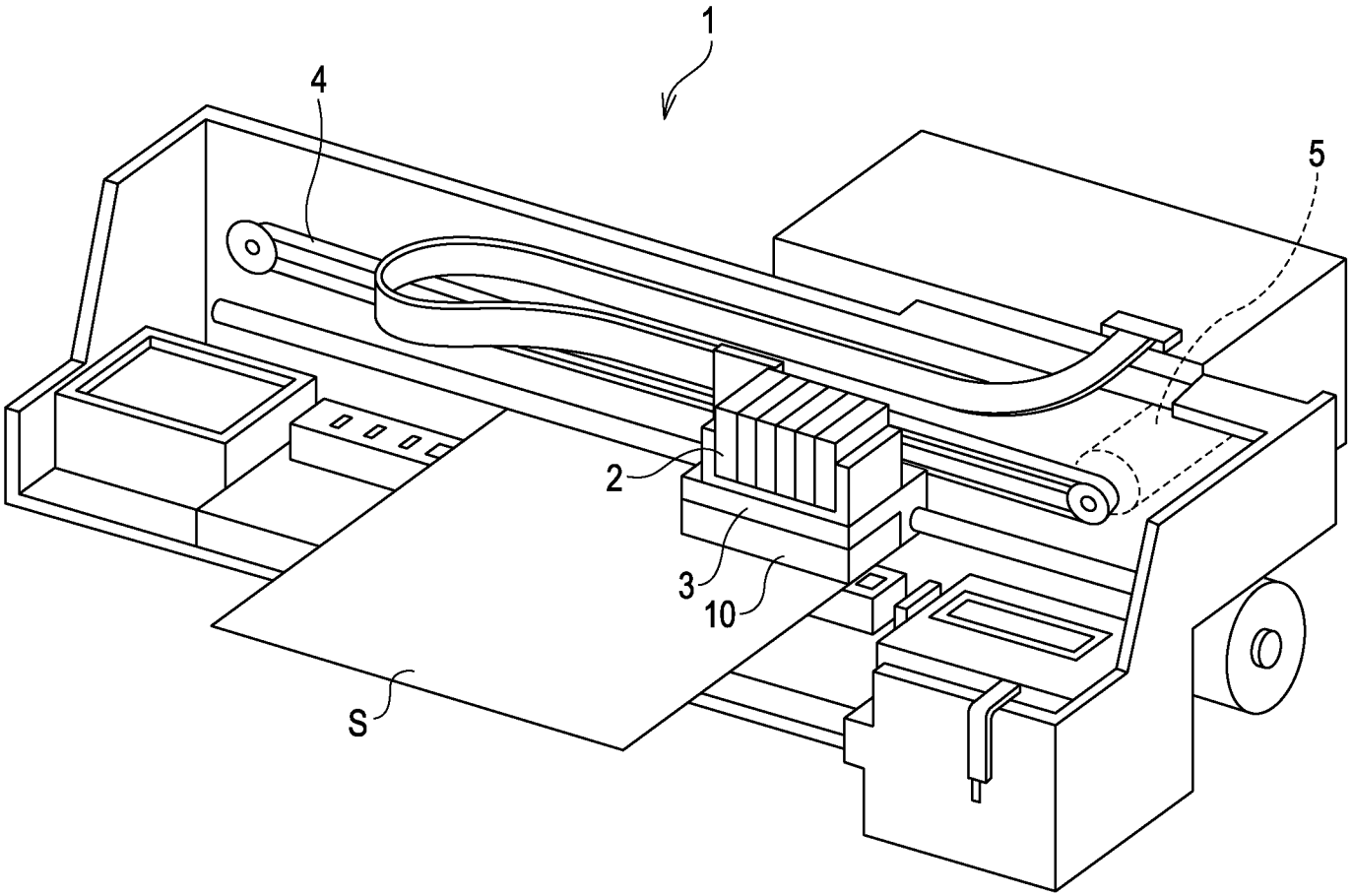
FIG. 1 is a general perspective view of a liquid ejecting apparatus according to an embodiment of the invention.

An ink jet recording apparatus will be described based on FIG. 1. As illustrated in FIG. 1, an ink jet recording apparatus 1 serving as a liquid ejecting apparatus includes an ink jet recording head (called simply a "head" hereinafter) 10 serving as a liquid ejecting head. The head 10 is anchored to a carriage 3 in which an ink cartridge 2 is mounted. The carriage 3 has a box shape whose upper portion is open, and is attached so that a nozzle surface of the head 10 is exposed on the surface that faces recording paper S (that is, the bottom surface); the ink cartridge 2 is housed within the carriage 3. Ink from the ink cartridge 2 is supplied to the head 10.

The carriage 3 is connected to a stepping motor 5 via a timing belt 4, and moves back and forth in the paper width direction of the recording paper S (that is, in the main scanning direction). Through this, ink droplets are ejected onto the top surface of the recording paper S while moving the carriage 3, thus printing images, text, or the like on the recording paper S in a dot matrix.

Note that the example shown in FIG. 1 illustrates an example in which the ink cartridge 2 is held in the carriage 3 as a liquid source, but the invention can also be applied in the case of an ink jet recording apparatus configured so that the ink cartridge 2 is held in a different location than the carriage 3 and the ink is pressure-transferred to a flow channel formation member of the head 10 via a supply pipe.

Figure 2:
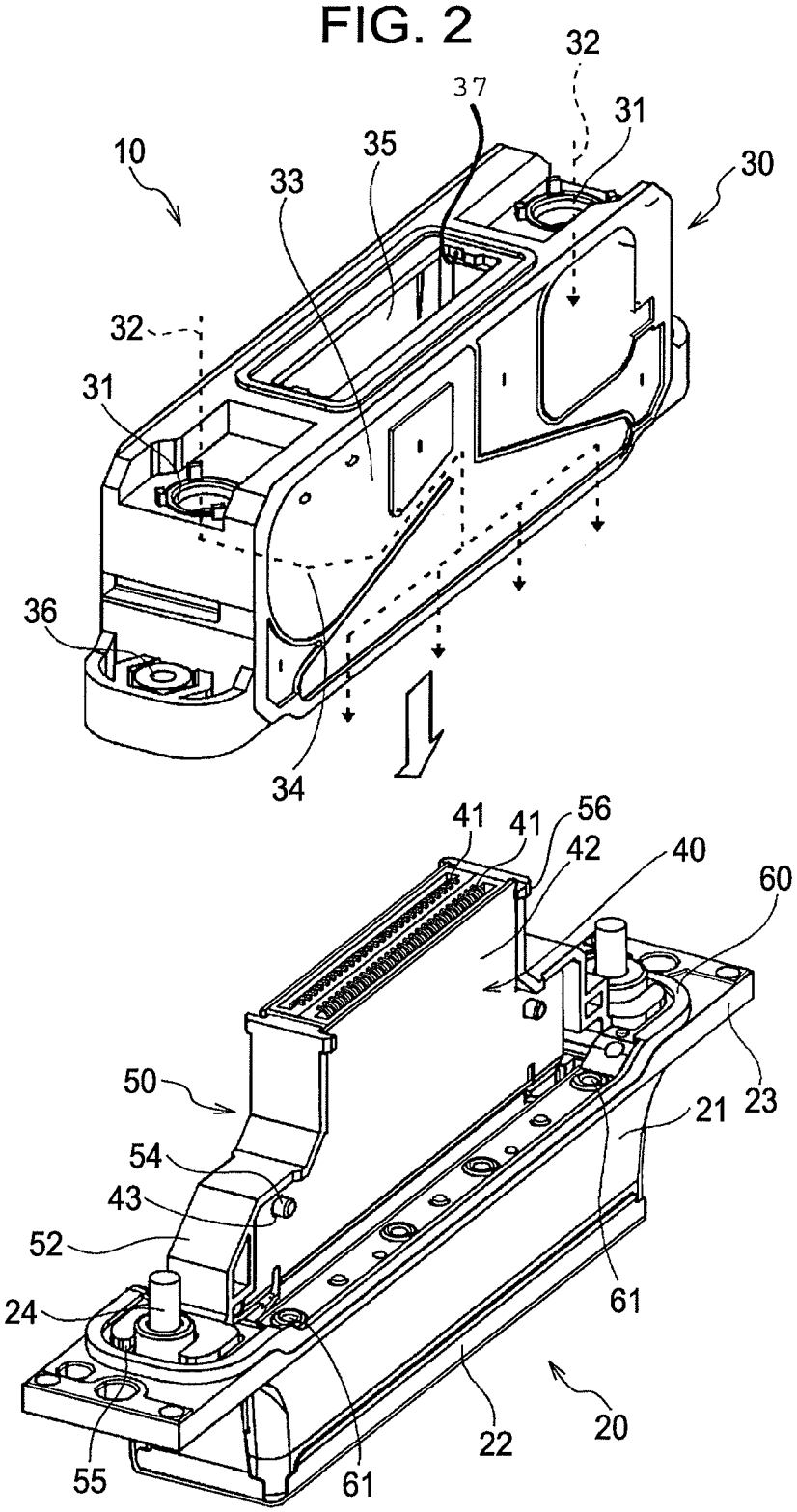
FIG. 2 is an exploded perspective view illustrating a head according to an embodiment of the invention.
Figure 3:
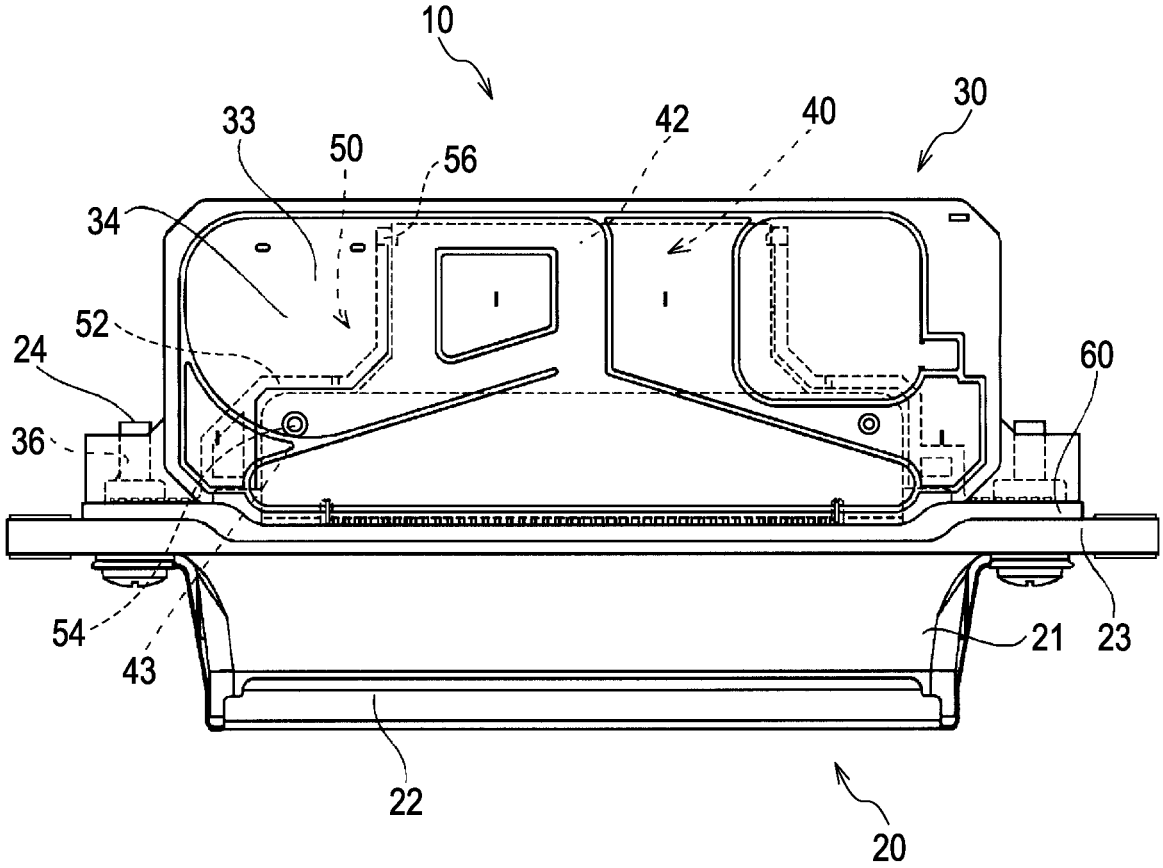
FIG. 3 is a front view of a head according to an embodiment of the invention.

The head 10 will now be described using FIGS. 2 and 3. The head 10 includes a main head body 20 and a self-sealing unit 30 (liquid introduction unit) in which a liquid introduction channel for introducing ink from the ink cartridge 2 (see FIG. 1) to the head 10 is formed.

The main head body 20 includes a head case 21, and a head cover 22 that protects the bottom end surface of the main head body 20 is provided in the head case 21. An opening (not shown) that exposes nozzle openings (described later) is formed in the head cover 22.

Figure 4:
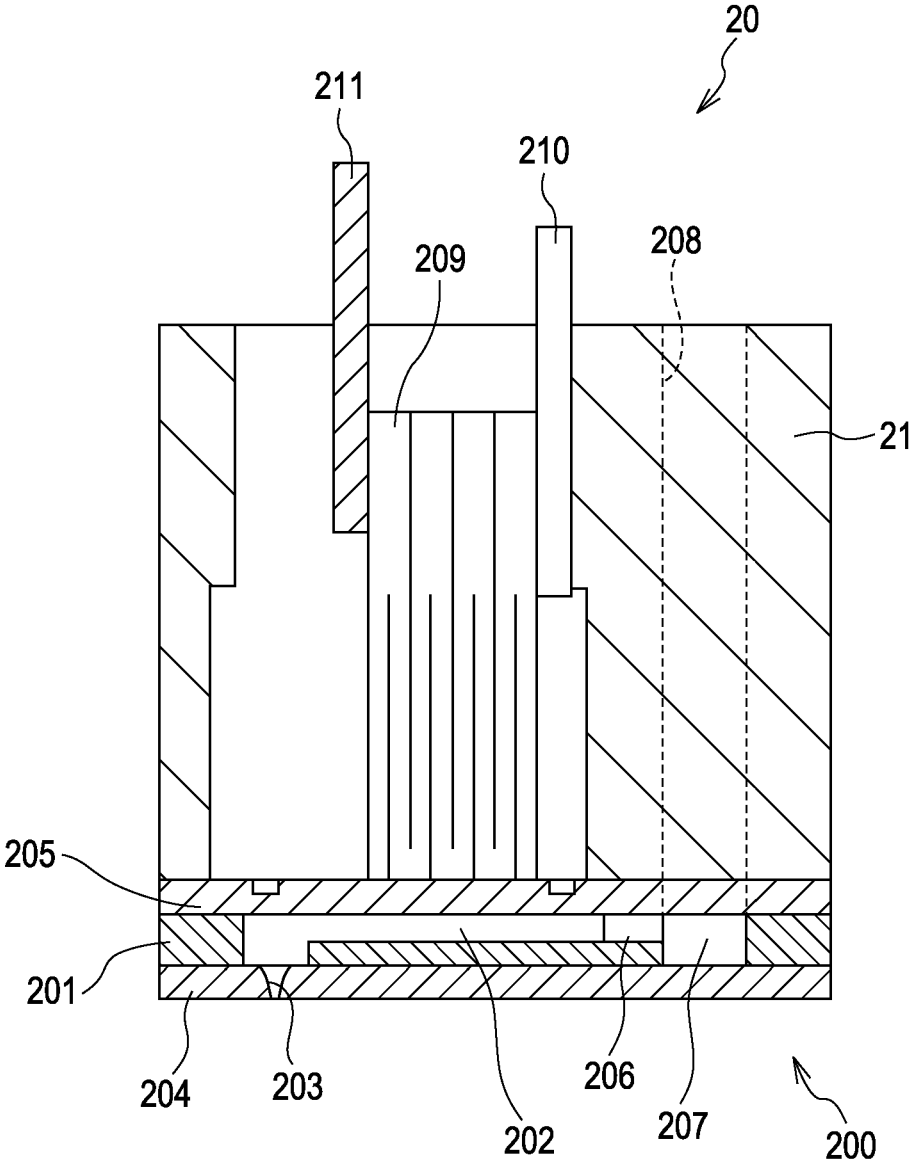
FIG. 4 is a cross-sectional view of a main head body according to an embodiment the invention.

The main head body 20 will now be described using FIG. 4. A flow channel formation portion 200 is provided in the lower end of the head case 21 of the main head body 20. The flow channel formation portion 200 includes a flow channel substrate 201. To illustrate further, multiple pressure generation chambers 202 are arranged in parallel in the flow channel substrate 201; the surfaces on both sides of the flow channel substrate 201 are sealed by a nozzle plate 204 having nozzle openings 203 corresponding to respective pressure generation chambers 202, and by a vibration plate 205. The nozzle openings 203 are arranged in a row in the lengthwise direction in the bottom surface of the main head body 20. Furthermore, a reservoir 207, serving as a common ink chamber for the multiple pressure generation chambers 202, is formed in the flow channel substrate 201 so as to communicate with each of the pressure generation chambers 202 via an ink communication channel 206. A head case flow channel 208 provided in the head case 21 communicates with the reservoir 207. Ink is supplied to the reservoir 207 from the self-sealing unit 30 (see FIG. 2) via this head case flow channel 208.

Meanwhile, piezoelectric elements 209, serving as pressurizing units, are provided on the vibration plate 205 on the side opposite to the pressure generation chambers 202, with the ends of each piezoelectric element 209 making contact with a region corresponding to a respective pressure generation chamber 202. These piezoelectric elements 209 are configured by vertically and alternately layering piezoelectric materials and electrode-forming materials in a sandwich-like shape, and a non-volatile region that does not contribute to vibrations is anchored to an anchor plate 210. Meanwhile, a wiring member 211 is connected to a respective piezoelectric element 209, and a driving signal is inputted into an electrode of the piezoelectric element 209 formed of the electrode-forming material from this wiring member 211.

With the ink jet recording head 10 configured in this manner, ink is supplied to the reservoir 207 via the head case flow channel 208 that communicates with the self-sealing unit 30, thus distributed to the pressure generation chambers 202. To explain this in more detail, the piezoelectric element 209 constricts as a result of the application of the driving signal from the wiring member 211 thereto. As a result, the vibration plate 205 deforms along with the piezoelectric elements 209 (in FIG. 4, retracts in the upward direction), causing the capacity of the pressure generation chambers 202 to increase, thereby pulling ink into the pressure generation chambers 202. After ink has been filled in the chambers up to the nozzle openings 203, the voltage applied to the piezoelectric elements 209 is removed based on the driving signal, causing the piezoelectric elements 209 to extend and return to their original states. Through this, the vibration plate 205 is also displaced and returns to its original state, thereby causing the pressure generation chambers 202 to shrink, increasing the internal pressure thereof and discharging ink droplets from the nozzle openings 203 as a result. In other words, in this embodiment, longitudinally-vibrating piezoelectric elements 209 are provided as pressurizing units causing a change in the pressure of the pressure generation chambers 202.

Returning to FIGS. 2 and 3, a flange portion 23 is formed on the upper surface side of the main head body 20, or in other words, on the side opposite to the bottom surface on which the head cover 22 that covers the nozzle plate is provided. The head 10 includes an FPC (Flexible Print Cable) 40 serving as a driving board upon this flange portion 23.

The FPC 40 is a film-form driving board that can be bent. The FPC 40 is bent and held erect relative to the flange portion 23 by a holding member 50, which will be described in detail later. The holding member 50 is provided upright on the flange portion 23 of the main head body 20.

The FPC 40 includes connectors 41 for connecting to an external wiring member (not shown) from a main printer unit. The FPC 40 also includes a board terminal portion (not shown) for sending signals to the aforementioned piezoelectric elements, and the wiring member 211 (see FIG. 4) connected to each piezoelectric element is electrically connected to this board terminal portion using solder or the like. In other words, the FPC 40 is configured to receive a driving signal from the main printer unit through a printer cable connected to the connectors 41 and supply that driving signal to the piezoelectric element through the wiring member 211 connected to the board terminal portion.

The self-sealing unit 30 is provided on the top of the flange portion 23 of the main head body 20. The self-sealing unit 30 has a rectangular block shape having a rectangular panel; ink introduction holes 31 are provided at the ends of the upper portion thereof, and ink is supplied from the ink cartridge 2 (see FIG. 1) into the respective ink introduction holes 31. The ink supplied into one of the ink introduction holes 31 (on the left in FIG. 2) passes through a unit flow channel 32 (indicated by a dotted line in FIG. 2) provided within the self-sealing unit 30 and is sent to a main flow channel 33 provided in the panel surface of the self-sealing unit 30, whereas the ink supplied into the other of the ink introduction holes 31 (on the right in FIG. 2) passes through the unit flow channel 32 and is sent to a main flow channel provided on the rear side of the paper surface in FIG. 2. In other words, in the self-sealing unit 30 according to this embodiment, two unit flow channels 32 are provided in a symmetrical manner. Ink that has flowed through this main flow channels 33 is sent from the outer side of the panel surface to a lower portion on the inner side of the self-sealing unit 30, and is then sent to the head case flow channel 208 of the main head body 20 from four discharge holes (not shown).

Furthermore, valves (not shown) are provided in the unit flow channels 32 between the respective ink introduction holes 31 and entry portions 34 of the main flow channels 33, the valves operating so as to allow the flow of ink when the pressure in the reservoir of the main head body 20 drops, or in other words, when ink is ejected and the pressure in the main flow channels 33 has become relatively lower. In other words, in the case where ink is being supplied from the ink introduction holes 31 at a predetermined pressure, the valve is put into a closed state, and when the pressure in the posterior areas drops due to the ejection of ink, the valve is put into an open state due to the negative pressure generated thereby, and the ink is supplied to the main head body 20.

An FPC passage portion 35 is formed in the central area of the self-sealing unit 30. The FPC passage portion 35 is a cavity whose top and bottom are open, and is configured so as to house the FPC 40 held by the holding member 50. When the FPC 40 is housed in the FPC passage portion 35, the connectors 41 of the FPC 40 face the upper opening of the FPC passage portion 35.

In the case where the self-sealing unit 30 is to be installed in the main head body 20, positioning pins 24 provided in the main head body 20 are inserted into positioning holes 36 provided on the right and left areas of the self-sealing unit 30, thus performing the positioning. Note that the positioning pins 24 are bolts provided in the bottom surface of the flange portion 23 of the main head body 20, and the self-sealing unit 30 is anchored to and installed in the main head body 20 by inserting the positioning pins 24 into the positioning holes 36.

Meanwhile, the head 10 includes a sealing member 60 provided upon the flange portion 23 of the main head body 20. In the case where the self-sealing unit 30 is installed in the main head body 20, the sealing member 60 is installed between the main head body 20 and the self-sealing unit 30, and serves to ensure the seal between the openings of the head case flow channel 208 formed in the main head body 20 and the discharge holes within the self-sealing unit 30. Sealing member openings 61 that pass into and communicate with the openings of the head case flow channel 208 and the discharge holes within the self-sealing unit 30 are provided in the sealing member 60.

Figure 5B:
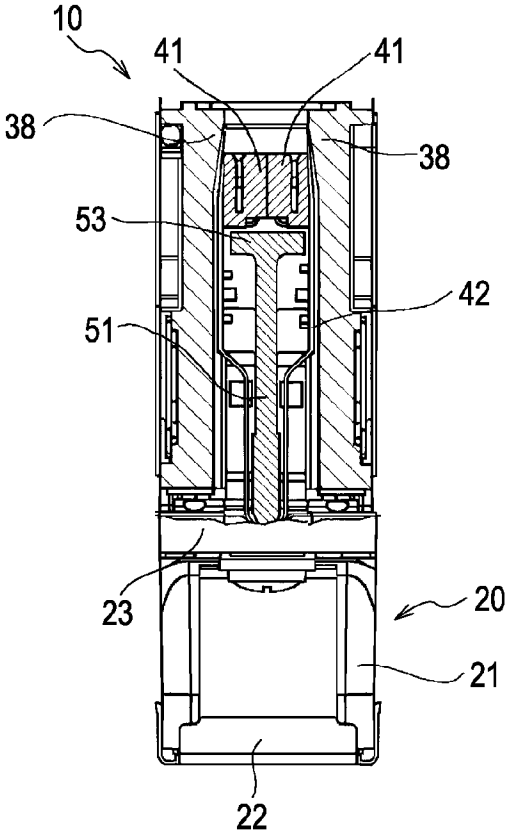
FIG. 5B is a partial cross-sectional view of a head according to an embodiment of the invention.
Figure 5A:
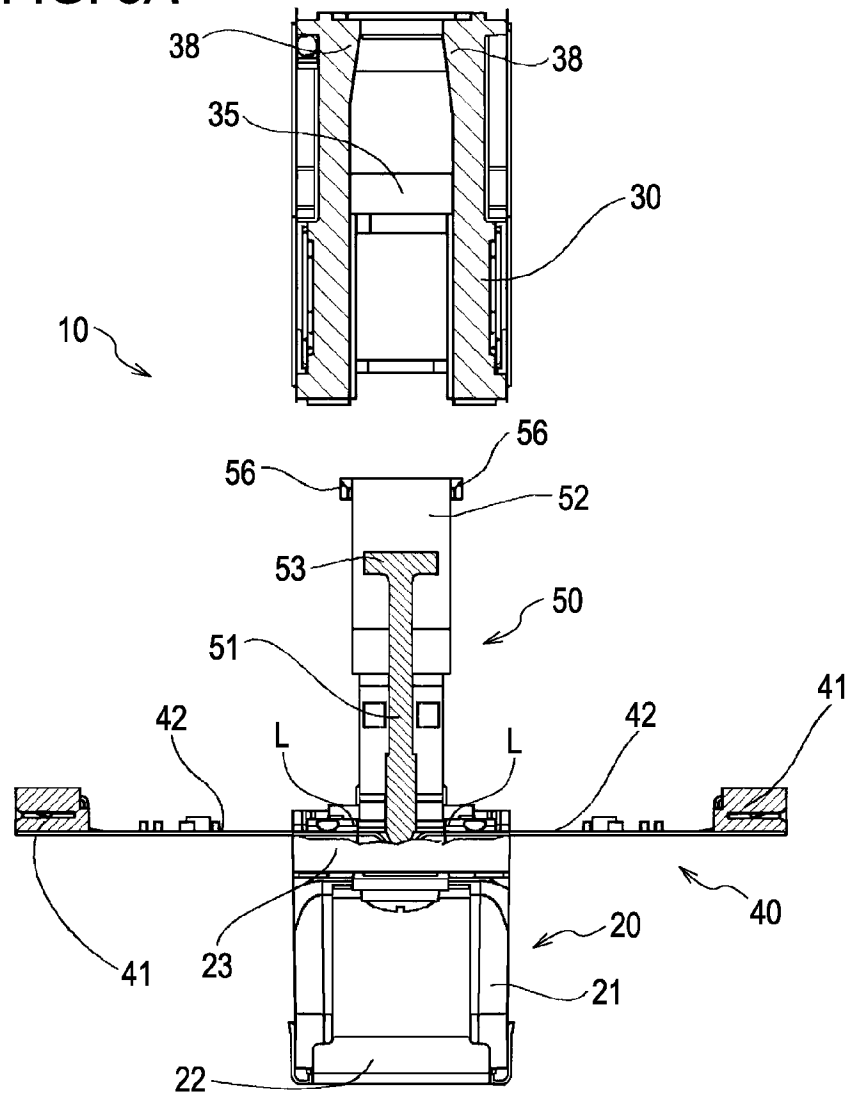
Figure 6:
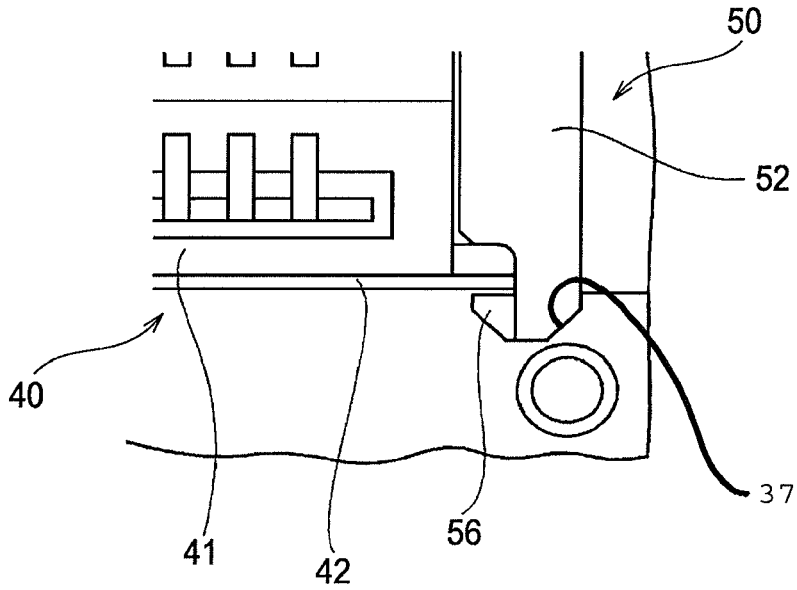
FIG. 6 is an enlarged partial top view of a head according to an embodiment of the invention.

Next, the FPC 40 and the holding member 50 will be described in detail using FIGS. 5 and 6 as well.

The FPC 40 is a driving board configured of a single strip of film, and the board terminal portion is formed in the central area thereof. Two bending portions L that span the FPC 40 in the width direction are set on both sides of the central area in which the board terminal portion is formed. Wires and so on are provided in main FPC portions 42, which correspond to the regions outside of the respective bending portions L of the FPC 40. The aforementioned connectors 41 are provided, connected to these wires, on the inner side of the ends of the main FPC portions 42 (that is, the inner side of the ends that are at the top when the FPC 40 is bent).

The FPC 40 is bent at an approximately right angle in the upward direction (toward the self-sealing unit 30) at each of the bending portions L. In this bent state, the FPC 40 is attached to and held by the holding member 50, which is erected on the main head body 20. Through this, the FPC 40 is erected relative to the upper end surface of the main head body 20, and is disposed in a state in which the two main FPC portions 42 are parallel to a nozzle row direction.

The holding member 50 is configured of a holding plate portion 51 for holding the FPC 40 and attachment portions 52 provided on both sides of the holding plate portion 51 in the nozzle row direction. The holding plate portion 51 has a base portion 53 extending from the upper portion thereof, and as a result, the cross-section of the holding plate portion 51 is approximately T-shaped. Fitting projections 54 are provided in the holding plate portion 51 on each plate surface thereof. The fitting projections 54 fit into fitting holes 43 in the bent FPC 40, thus holding the FPC 40 to each plate surface.

The attachment portions 52 are for attaching the holding plate portion 51 to the flange portion 23 of the head case 21. Each attachment portion 52 is configured so as to be integral with the holding plate portion 51, and openings 55 are provided so as to be parallel with the flange surface. The openings 55 fit with the positioning pins 24 provided in the flange portion 23. Through this, the holding member 50 is positioned on and attached to the flange portion 23.

The holding member 50 is attached in the following manner. After first mounting the FPC 40 on the flange portion 23 of the head case 21, the positioning pins 24 of the holding member 50 are inserted into the openings 55 of the attachment portion 52, thus positioning and disposing the holding member 50 on the flange portion 23. Through this, the holding member 50 is positioned relative to the flange portion 23 and is attached to the head case 21 in a state in which the holding plate portion 51 is erected relative to the upper end surface of the main head body 20. The FPC 40 is then bent at each of the bending portions L, the fitting projections 54 are fitted into the fitting holes 43 of the main FPC portions 42, and the FPC 40 is held by both surfaces of the holding plate portion 51 of the holding member 50; the connector 41, meanwhile, is mounted on the base portion 53. In other words, with the FPC 40, the holding member 50 is disposed upon the central area on the inside of the two bending portions L in which the board terminal portion is formed, and the two main FPC portions 42 are held by respective plate surfaces of the erected holding plate portion 51.

In order to prevent the FPC 40 from opening up in the opposite direction as the bending direction (the outward direction) in the bending process, claw portions 56 that stop the upper end areas of the main FPC portions 42 of the FPC 40 are provided in the attachment portion 52 in this embodiment. The FPC 40 opens outward with ease due to the weight of the connector 41. In other words, although the FPC 40 opens in the opposite direction as the bending direction with ease, in this embodiment, it is possible to stop the FPC 40 using the claw portions 56 and restrict the FPC 40 from opening in the outward direction. Specifically, the FPC 40 is wider in the width direction than the connector 41, and thus the FPC 40 can be prevented from opening in the outward direction by the portions of the FPC 40 that protrude beyond the connector 41 in the width direction interlocking relative to the claw portions 56. Here, "interlocking relative to" has the following meaning. That is, the structure may be such that one of these elements (for example, the claw portions 56) interlocks with the other of the elements (for example, the portions of the FPC 40 that protrude beyond the connector 41 in the width direction), without being restricted to a master/slave relationship, so that the two elements interlock with each other. Note that the portions of the FPC 40 that protrude beyond the connector 41 in the width direction are configured of a material that bends more easily than the connector 41, and can therefore be pushed into the claw portions 56 with ease. Accordingly, in this embodiment, when the self-sealing unit 30 is installed upon the head case 21 in the assembly process, the FPC 40 does not open up, which makes it possible to install the self-sealing unit 30 with ease. Furthermore, because the FPC 40 is held at the upper portion thereof, the connector 41 does not wobble even after the assembly process; this makes it easy to insert and anchor the printer cable to the connector 41, which in turn makes it possible to suppress the defect rate when manufacturing the liquid ejecting head.

In this case, it is preferable for the claw portions 56 to stop the FPC 40 as close to the upper end portions thereof as possible in order for the claw portions 56 to restrict the FPC 40 from opening up in the outward direction. In this embodiment, the claw portions 56 are provided at the uppermost end of the attachment portion 52.

Furthermore, in the case where the self-sealing unit 30 is to be installed in a state in which the FPC 40 is held by the holding member 50 in such a manner, a tapered surface 38, serving as a restricting portion for restricting the position of the connector 41, is provided, in this embodiment, in the vicinity of the upper opening of the FPC passage portion 35 in the self-sealing unit 30 in order to further suppress the connector 41 from wobbling after the FPC 40 and the holding member 50 have been inserted into the FPC passage portion 35 of the self-sealing unit 30. In other words, the tapered surface (sloped surface) 38 is provided in the vicinity of the upper opening of the FPC passage portion 35 so that the surface area of the opening of the FPC passage portion 35 narrows as it proceeds toward the upper opening.

This is because there are situations in which, because the FPC passage portion 35 is provided so as to be bigger than the FPC 40 and the holding member 50, the connector 41 that is exposed in the upper opening wobbles, despite being held by the claw portions 56, due to its position not being restricted. In order to prevent this, in this embodiment, the tapered surface 38 is further provided in the vicinity of the upper opening of the FPC passage portion 35. Through this, the surface area of the opening narrows and makes contact with the connector 41, thus further restricting the position of the connector 41, and suppressing the connector 41 from wobbling.

In addition, in the case where the holding member 50 and the FPC 40 are inserted into the FPC passage portion 35 of the self-sealing unit 30, grooves 37 are formed in accordance with the shapes of the claw portions 56 of the attachment portion 52 of the holding member 50. This makes the insertion easier, and makes it easier to install the self-sealing unit 30 during the assembly process.

Although a preferred embodiment of the invention has been described thus far, the invention is not intended to be limited to this embodiment. For example, the stopping portions for the FPC 40 in the holding member 50 are not limited to the claw portions 56. A pinching member that pinches the connector 41 from both ends in the lengthwise direction thereof may be provided as a stopping member on the inner side of the upper areas of the attachment portion 52 in the holding member, thus preventing the FPC 40 from opening up in the opposite direction as the bending direction. Not only can the connector 41 be held by this pinching member, but the connector 41 can also be anchored by the tapered surface 38 of the self-sealing unit 30.

Although the aforementioned embodiment describes the tapered surface 38 as being provided in the vicinity of the upper opening of the FPC passage portion 35 in the self-sealing unit 30, the shape of the restricting portion for restricting the position of the connector 41 is not limited to the tapered surface 38. For example, projections that protrude toward the inside may be provided in the vicinity of the upper opening of the FPC passage portion 35, and the shape of these projections is also not particularly limited. Furthermore, it is preferable to provide a ridge portion in which a taper that reduces the surface area of the opening as it progresses toward the upper opening is provided, rather than simply holding the FPC 40 and the holding member 50 using the tapered surface 38 as described in the aforementioned embodiment. There are also cases in which forming the entire surface with high precision is difficult, and thus insertion is also difficult; therefore it is preferable to provide multiple ridge portions, in which tapers are provided, along the periphery of the upper opening in the FPC passage portion 35, rather than simply employing the tapered surface 38.

Furthermore, the shape of the tapered surface is not limited. For example, the tapered surface 38 provided in the upper opening of the FPC passage portion 35 may be configured having a sloped portion in which the surface area of the opening is sloped so as to become narrower as it progresses in the upward direction, and a straight portion in which the surface area of the opening is constant.

Although the self-sealing unit 30 is illustrated as an example in the aforementioned embodiment, the unit flow channel is not limited. For example, although the aforementioned embodiment illustrates an example of a self-sealing unit in which a valve is provided, the self-sealing unit may be a unit that includes a liquid flow channel in which a valve is not provided.

Furthermore, although the aforementioned embodiment describes an ink jet recording head as an example of a liquid ejecting head, the invention is targeted at liquid ejecting heads in general, and thus can of course be applied in liquid ejecting heads that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads.

What is claimed is:

1. A liquid ejecting head comprising:

a main liquid ejecting head body, in which a liquid flow channel, through which a liquid flows, is disposed, wherein the main liquid ejecting head body ejects the liquid from a nozzle opening using a pressurizing unit;

a driving board configured so as to supply power to the pressurizing unit, wherein the driving board is bent into a shape with:

at least one extremity extending away from one end surface of the main liquid ejecting head body, and a first portion transverse to the extremity and adjacent the end surface of the main liquid ejecting body;

a connector provided at an end portion of the extremity of the driving board;

a holding member that holds the driving board in the bent state, wherein the holding member comprises a fastener that holds a region of the driving board adjacent the connector; and a liquid introduction unit, disposed on the one end surface of the main liquid ejecting head body, comprising:

a liquid introduction channel that introduces the liquid into the liquid flow channel;

a driving board passage portion that is open at the top and bottom;

an exposure portion that exposes the connector from an upper opening of the driving board passage portion when the holding member and the driving board held by the holding member have been inserted into the driving board passage portion;

a restricting portion configured to restrict the position of the connector by making contact with the connector at the inner wall of at least the upper opening of the driving board passage portion, wherein the restricting portion is tapered, so that the surface area of the opening of the restricting portion decreases as the opening progresses toward the upper opening, such that, during insertion of the driving board and the holding member into the liquid introduction unit, the restriction portion compresses the driving board; and a groove in the inner wall of the driving board passage portion which matches the shape of the fastener, configured to provide clearance for the fastener during the insertion of the driving board and the holding member into the liquid introduction unit.

2. The liquid ejecting head according to claim 1, wherein second portions of the driving board that protrude beyond the connector in a width direction are composed of a material that is more bendable than the connector; and the fastener interlocks with the second portions of the driving board;

wherein the width direction is transverse to a longitudinal direction of the first portion of the driving board and to a longitudinal direction of the extremity.

3. A liquid ejecting apparatus comprising:

the liquid ejecting head according to claim 1.

* * * * *